US006793540B2

(12) United States Patent
Peng

(10) Patent No.: US 6,793,540 B2
(45) Date of Patent: Sep. 21, 2004

(54) METHOD FOR MANFACTURING INSULATION DISPLACEMENT CONNECTOR AND STRUCTURE THEREOF

(76) Inventor: Yuan-Huei Peng, 4F, No. 12, Lane 270, Sec. 3, Pei Shen Rd., Shen Keng Shiang, Taipei County 222 (TW)

( * ) Notice: Subject to any disclaimer, the term of this patent is extended or adjusted under 35 U.S.C. 154(b) by 0 days.

(21) Appl. No.: 10/403,225

(22) Filed: Mar. 31, 2003

(65) Prior Publication Data

US 2004/0092153 A1 May 13, 2004

(30) Foreign Application Priority Data

Nov. 7, 2002 (TW) ..... 91132826 A

(51) Int. Cl.[7] ..... H01R 9/22

(52) U.S. Cl. ..... 439/722; 439/736; 29/883; 264/272.11

(58) Field of Search ..... 439/722, 736, 439/676; 29/883, 884; 264/272.11

(56) References Cited

U.S. PATENT DOCUMENTS 6,010,370 A * 1/2000 Aihara et al. ..... 439/660
6,135,821 A * 10/2000 Liu ..... 439/676
6,280,231 B1 * 8/2001 Nicholls ..... 439/402

* cited by examiner

*Primary Examiner*—Tho D. Ta
(74) *Attorney, Agent, or Firm*—Webb Ziesenheim Logsdon Orkin & Hanson, P.C.

(57) ABSTRACT

A method for manufacturing an insulation displacement connector is provided. The method includes steps of providing an injection molding device, providing a first and a second terminals, putting the first and the second terminals into the injection molding device, and injecting a molding material into the injection molding device for forming a first and a second terminal seats and a middle connecting portion, so that the first and the second terminals are simultaneously encapsulated and assembled by the first and the second terminal seats for completing the insulation displacement connector.

16 Claims, 6 Drawing Sheets

METHOD FOR MANFACTURING INSULATION DISPLACEMENT CONNECTOR AND STRUCTURE THEREOF

FIELD OF THE INVENTION

This invention relates to a method for manufacturing an insulation displacement connector and a structure thereof, and more particular to a method for manufacturing an insulation displacement connector and a structure thereof which can accelerate the production speed thereof.

BACKGROUND OF THE INVENTION

Generally, IDCs (Insulation Displacement Connectors) utilize double rows of terminals to connect to the conducting wires. The double rows of terminals are fixed in two terminal seats, wherein the terminal seats can be perpendicular or parallel to the printed circuit board for respectively applied to a relatively larger space located in one of a back end and an upper end of a pedestal of a keystone jack. Please refer to FIG. 1. It illustrates a three-dimensional assembling view of the insulation displacement connector in the prior art. The method for manufacturing the IDC 10 in FIG. 1 includes the steps described as follows: respectively injection molding a plastic case 11 and an inner scoop 12, affixing eight terminals 13 to the inner scoop 12 by an artificiality or an auto-equipment, putting the inner scoop 12 into the plastic case 11 through aiming the eight terminals 13 pf the inner scoop 12 at eight pre-kept holes 14 of the plastic case 11, and holding the inner scoop 12 in the plastic case 11 via fixing a tenon 15 of the plastic case 11 in a cavity 16 of the inner scoop 12. When the terminals 13 proceed a high-frequency signal transmission, the conductors of terminals 13 and the atmosphere therearound will form a capacitance.

Please refer to FIG. 2. It illustrates a three-dimensional assembling view of the IDC in FIG. 1 and a printed circuit board in the prior art. In this situation, the IDC 10 formed by the steps described above is perpendicularly assembled with a printed circuit board 20. Because the IDC is assembled as one unity by fixing and assembling the inner scoop 12 and the plastic case 11, the manufacturing processes are complicated as shown above. Particularly, the affixing way of the eight terminals 13 to affix to the inner scoop 12 not only is inconvenient but also causes an unstable disadvantage while the eight terminals 13 are fixed in the plastic case 11.

Because of the technical defects described above, the applicant keeps on carving unflaggingly to develop a "method for manufacturing insulation displacement connector and structure thereof" through wholehearted experience and research which.

SUMMARY OF THE INVENTION

It is an object of the present invention to provide a method of manufacturing an insulation displacement connector and a structure thereof for accelerating the production speed of the IDC.

It is another object of the present invention to provide a method which forms a first and a second terminal seats and a middle connection portion at the same time, namely, simultaneously affixes terminals to a double rows terminal seat.

It is a further object of the present invention to provide a fixing tenon of the first terminal seat for fixing the double-rows terminal seat in a keystone jack.

It is an additional object of the present invention to provide a first and a second tenons of the double-rows terminal seat for fixing a wire clip on the double-rows terminal seat.

In accordance with an aspect of the present invention, a method for manufacturing an insulation displacement connector includes steps of providing an injection molding device, providing a first and a second terminals, putting the first and the second terminals into the injection molding device, and injecting a molding material into the injection molding device for forming a first and a second terminal seats and a middle connecting portion, so that the first and the second terminals are simultaneously encapsulated and assembled by the first and the second terminal seats for completing the insulation displacement connector.

Preferably, the first terminal seat has a fixing tenon for being fixed in a keystone jack.

Preferably, the keystone jack has a pedestal scoop for holding the fixing tenon of the first terminal seat.

In accordance with another aspect of the present invention, a method for manufacturing an insulation displacement connector includes steps of providing an injection molding device, providing a first and a second terminals, injecting a molding material into the injection molding device for forming a first and a second terminal seats and a middle connecting portion, and simultaneously putting the first and the second terminals into the injection molding device, so that the first and the second terminals are encapsulated and combined by the first and the second terminal seats for completing the insulation displacement connector.

Preferably, the first terminal seat has a fixing tenon for being fixed in a keystone jack.

In accordance with further another aspect of the present invention, an insulation displacement connector structure for connecting a conducting wire and a circuit includes a first and a second terminal seats, a middle connecting portion located between and connecting the first and the second terminal seats, and a first and a second terminals disposed in the first and the second terminal seats respectively.

Preferably, the first and the second terminal seats are seamlessly assembled to the first and the second terminals.

Preferably, the first terminal seat has a fixing tenon for being fixed in a keystone jack.

Preferably, the keystone jack has a pedestal scoop for holding the fixing tenon of the first terminal seat.

Preferably, the keystone jack has a separated scoop for separating the keystone jack from a SIP (Snap In Plate).

Preferably, the first terminal seat has a first tenon for fixing a wire clip thereon and the wire clip has a plate bottom for being assembled to the keystone jack.

Preferably, the second terminal seat has a second tenon for cooperating with the first tenon to fix the wire clip on the first and the second terminal seats.

Preferably, the first and the second tenons are respectively located at a front end and a back end of the insulation displacement connector for further fixing a first and a second scoops of the wire clip.

Preferably, the middle connecting portion has plural hollow squares for saving a molding material.

Preferably, the first and the second terminal seats are made of the molding material injected from a plastic injection molding machine and the molding material is a liquid plastic.

In accordance with additional aspect of the present invention, an insulation displacement connector structure includes a first and a second terminals, and a first and a second terminal seats formed integrally and connected to the first and the second terminals seamlessly.

Preferably, the structure further includes a middle connecting portion located between and connecting the first and the second terminal seats and formed integrally with the first and the second terminal seats.

Preferably, the middle connecting portion has plural hollow squares for saving a molding material.

Preferably, the first and the second terminal seats are made of the molding material injected from a plastic injection molding machine and the molding material is a liquid plastic.

Preferably, the first terminal seat has a fixing tenon for being fixed in a keystone jack.

Preferably, the keystone jack has a pedestal scoop for holding the fixing tenon of the first terminal seat.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 3:
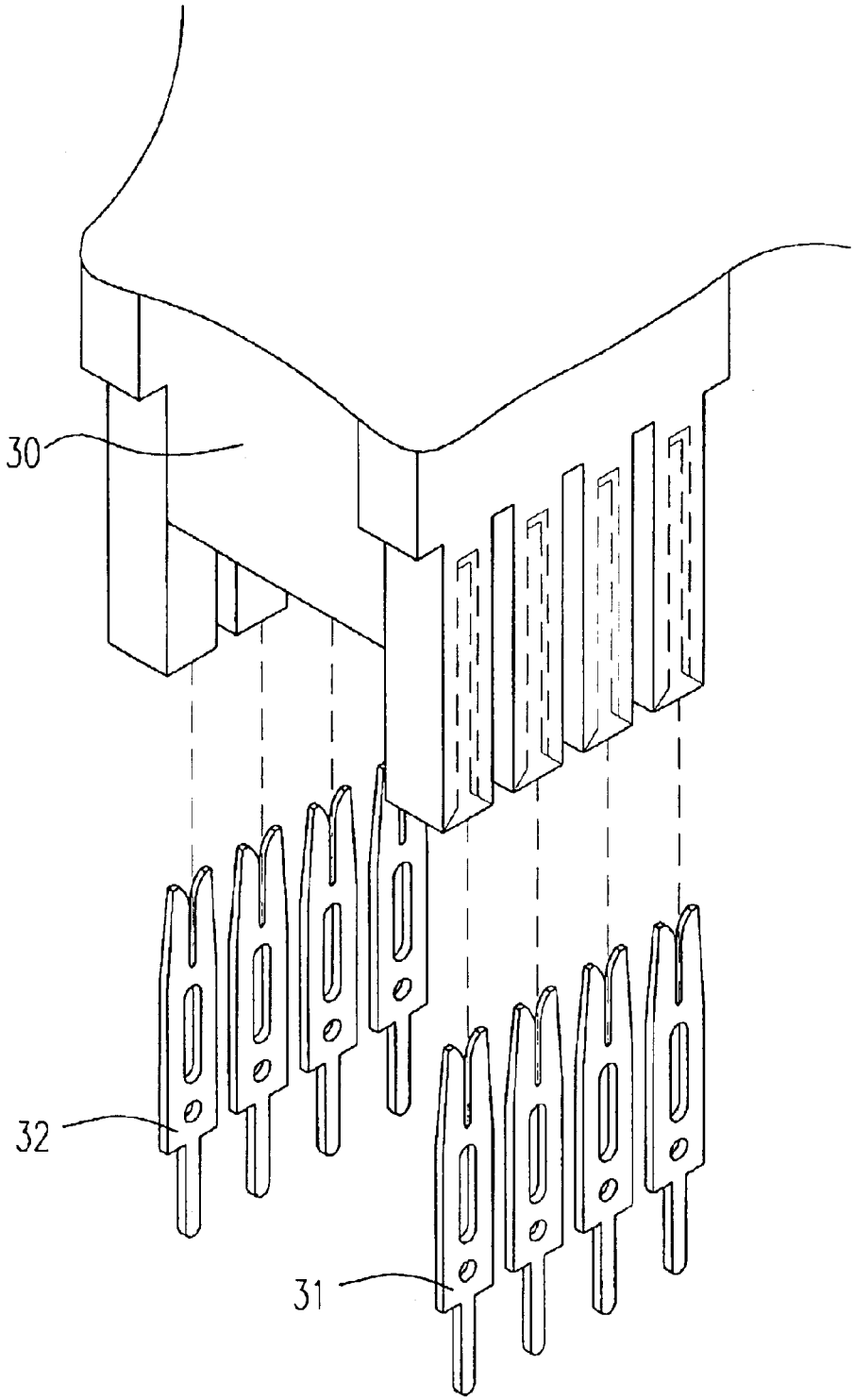
FIG. 3 shows a three-dimensional schematic view of a manufacturing process of the double-rows terminal seat in a preferred embodiment according to the present invention.
Figure 4:
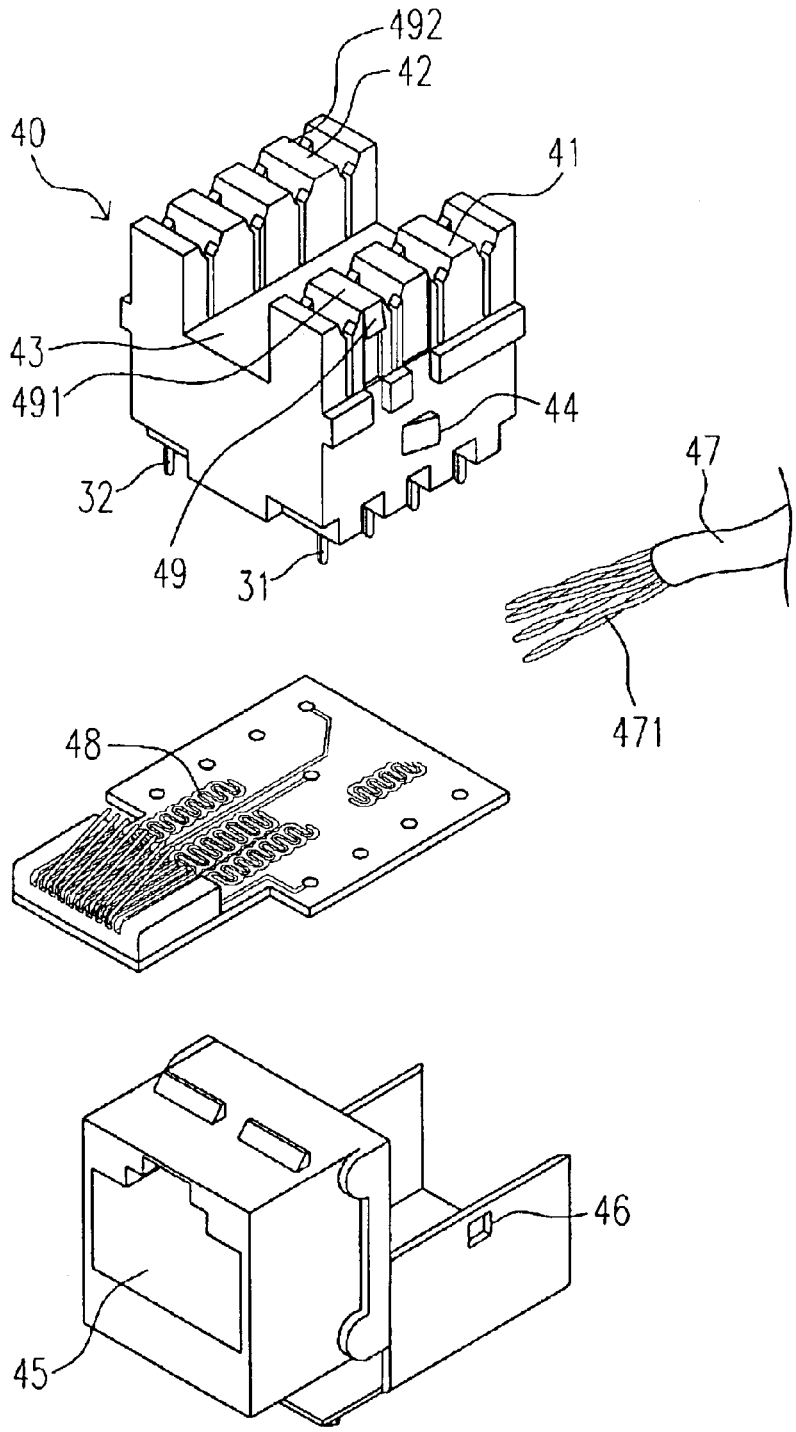
FIG. 4 shows a three-dimensional assembling view of the double-rows terminal seat formed in FIG. 3, a printed circuit board and a keystone jack in a preferred embodiment according to the present invention.

Please refer to FIGS. 3 and 4 which together illustrate the manufacturing process of an IDC 40 (Insulation Displacement Connector). The manufacturing processes include providing an injection molding device 30, providing four first and second terminals 31, 32, putting the first and second terminals 31, 32 into the injection molding device 30, and injecting a molding material into the injection molding device 30 for forming a first and a second terminal seats 41, 42 and a middle connecting portion 43, as shown in FIG. 4. Therefore, the first and second terminals 31, 32 are simultaneously encapsulated and assembled by the first and second terminal seats 41, 42 for completing the insulation displacement connector 40.

In this method, the first and second terminal seats have a fixing tenon 44 for being fixed in a keystone jack 45, wherein the keystone jack has two pedestal scoops 46 for holding the fixing tenon 44 of the first and second terminal seats 41, 42.

On the other hand, the present invention provides a further method for manufacturing an insulation displacement connector which is a type without previously putting the terminals into the injection molding device. The method includes steps of providing an injection molding device 30, providing four first and second terminals 31, 32, injecting a molding material into the injection molding device 30 for forming a first and a second terminal seats 41, 42 and a middle connecting portion 43, and simultaneously putting the first and second terminals 31, 32 into the injection molding device 30, so that the first and second terminals 31, 32 are encapsulated and combined by the first and second terminal seats 41, 42 for completing the insulation displacement connector 40. Certainly, in this method, the first and second terminal seats have a fixing tenon 44 for being fixed in a keystone jack 45.

On another point of view, the present invention provides an IDC structure for connecting a conducting wire 47 and a circuit 48 (as shown in FIG. 4). The IDC structure includes a first and a second terminal seats 41, 42, a middle connecting portion 43 located between and connecting the first and second terminal seats 41, 42, and a first and a second terminals 31, 32 disposed in the first and second terminal seats 41, 42 respectively, wherein the first and second terminal seats 41, 42 are seamlessly assembled to the first and second terminals 31, 32.

Figure 5:
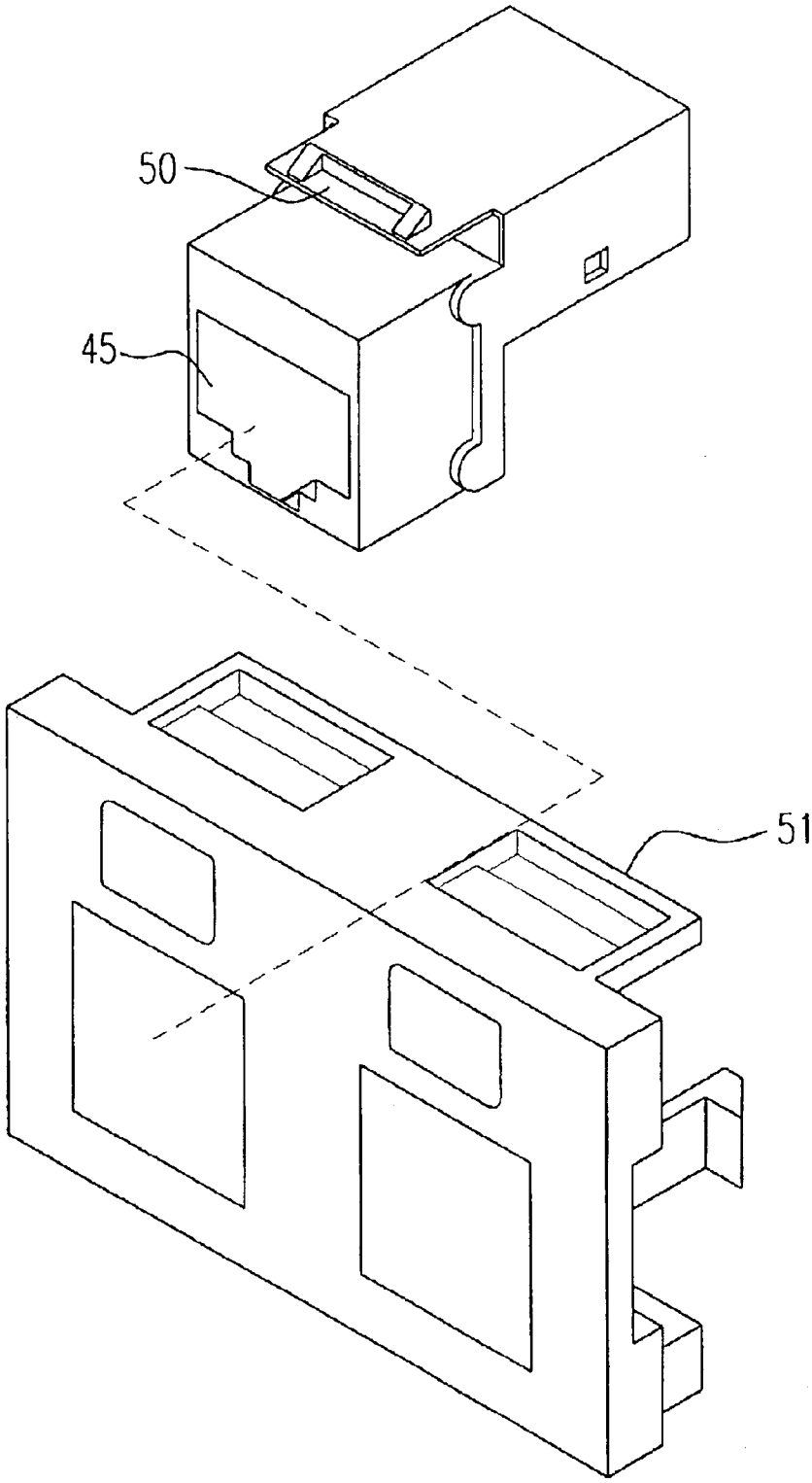
FIG. 5 shows an assembling process of the keystone jack in FIG. 4 and a snap in plate (SIP) according to the present invention.
Figure 6:
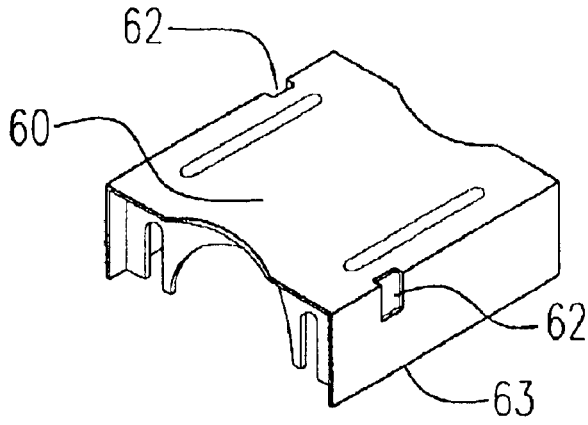
FIG. 6 shows a three-dimensional schematic view of a wire clip which is corresponding to the IDC in FIG. 4 according to the present invention.

In this structure, the first terminal seat 41 has a fixing tenon 44 for being fixed in a keystone jack 45, wherein the keystone jack 45 has a pedestal scoop 46 for holding the fixing tenon 44 of the first terminal seat 41. Moreover, the keystone jack 45 has a separated scoop 50 (as shown in FIG. 5) for separating the keystone jack 45 from a SIP (Snap In Plate) 51. And, the first terminal seat 41 has a first tenon 49 (as shown in FIG. 4) for fixing a wire clip 60 (as shown in FIG. 6) thereon and the wire clip has a plate bottom 63 for being assembled to the keystone jack 45. Thus, the eight wires 471 can be plugged into the IDC previously, and then the ends of the wires which are redundant can be cut by a clamp. Then, a clip 60 will be sleeved on the eight wires 471 for protection so as to avoid an interference or a damage.

Figure 7:
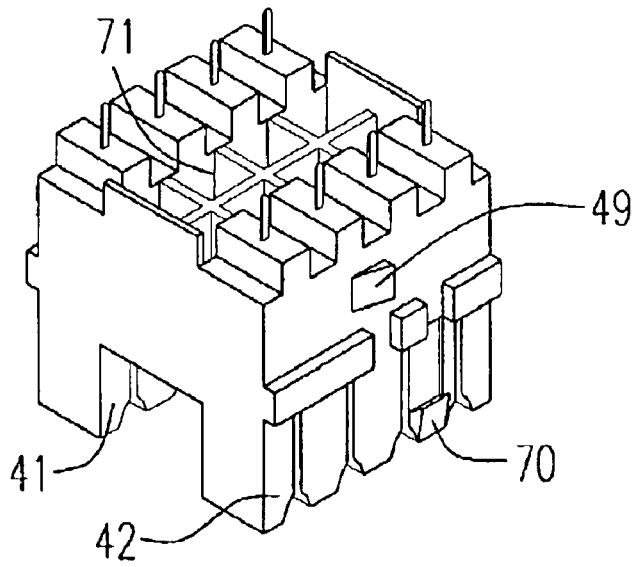
FIG. 7 shows a three-dimensional schematic view of a reverse side of the double-rows terminal seat in FIG. 4 according to the present invention.

The second terminal seat 42 has a second tenon 70 (as shown in FIG. 7) for cooperating with the first tenon 49 to fix the wire clip 60 on the first and second terminal seats 41, 42. And, the first and second tenons 49, 70 are respectively located at a front end 491 and a back end 492 of the insulation displacement connector 40 for further fixing a first and a second scoops 61, 62 of the wire clip 60.

Figure 1:
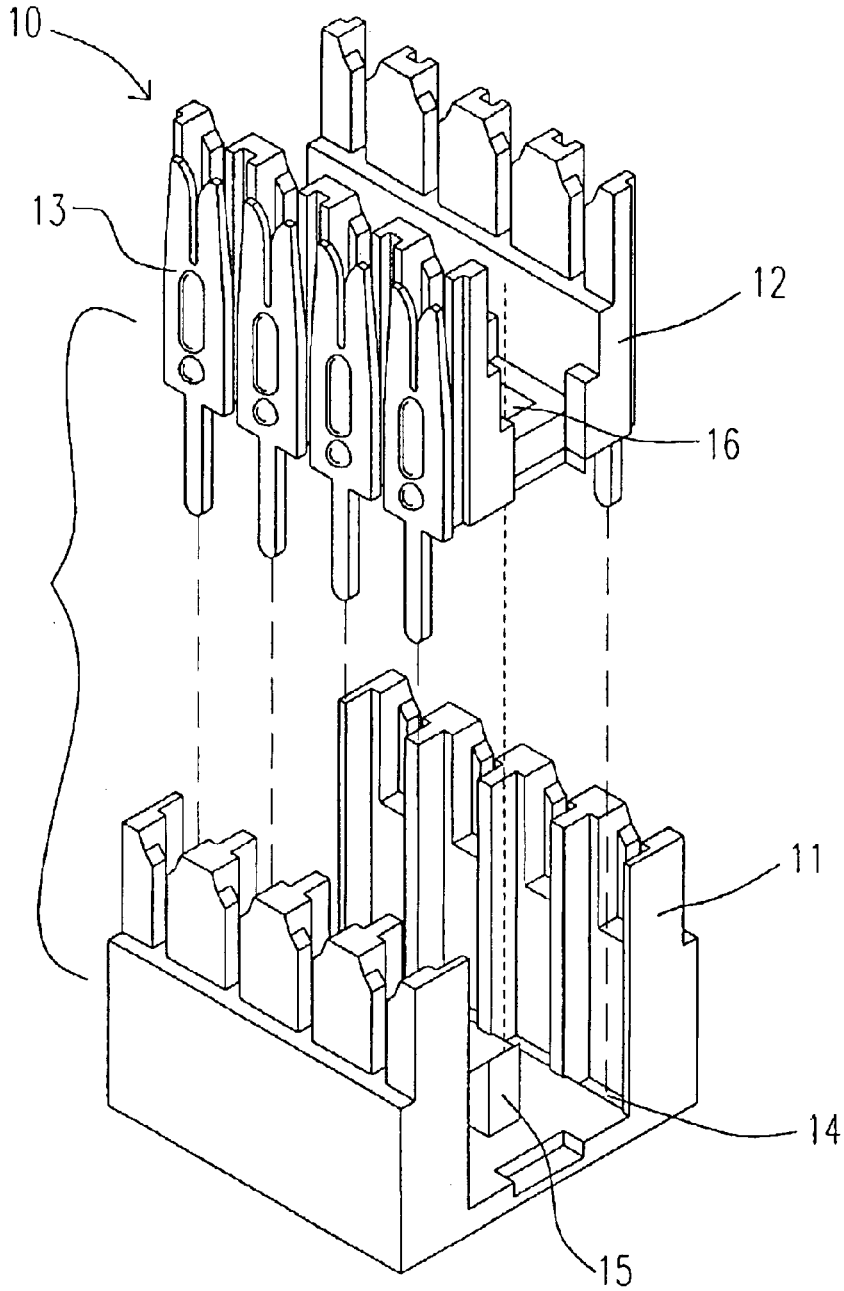
Fig. 1 (PRIOR ART)
FIG. 1 shows a three-dimensional assembling view of the insulation displacement connector (IDC) in the prior art.
Figure 2:
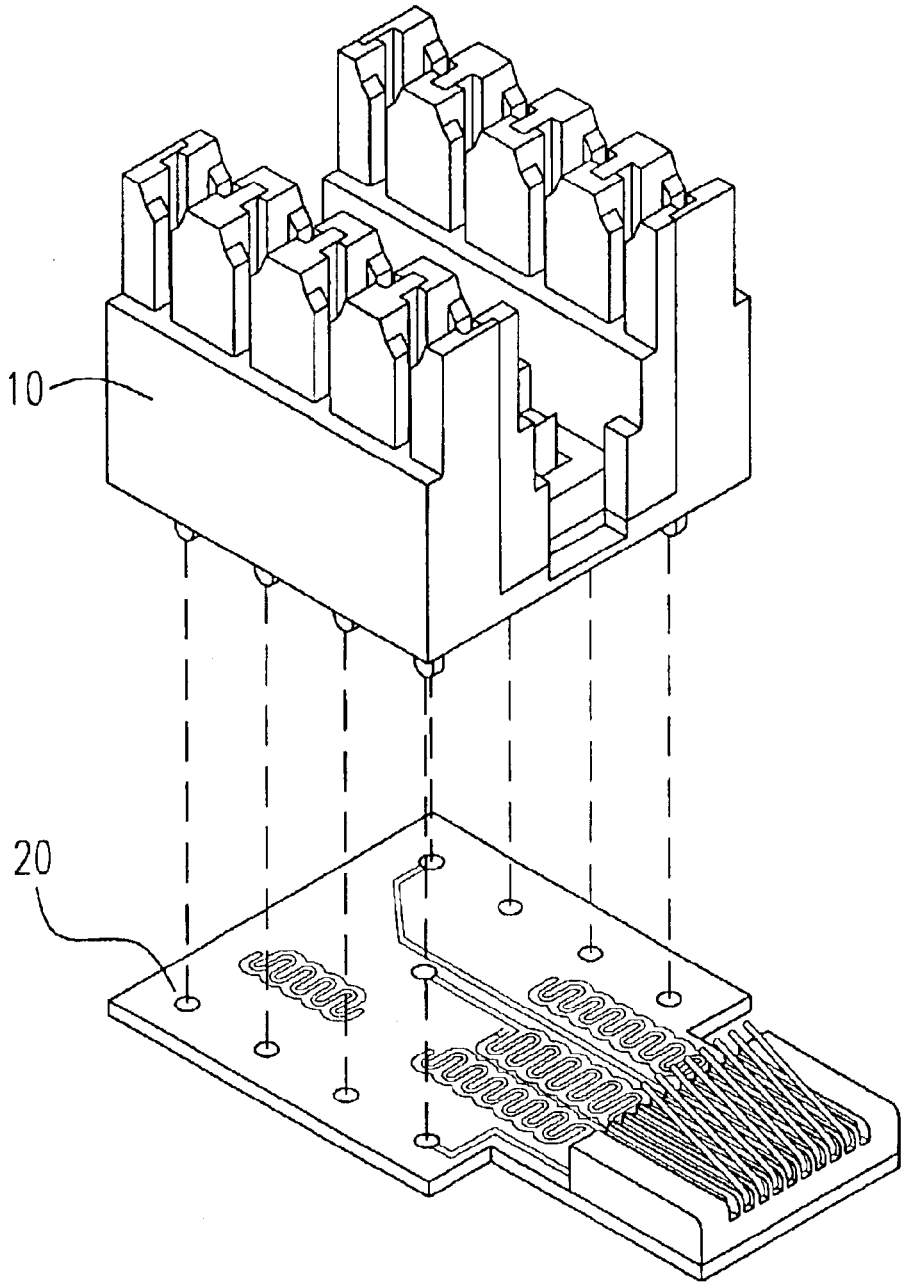
Fig. 2(PRIOR ART)
FIG. 2 shows a three-dimensional assembling view of the IDC in FIG. 1 and a printed circuit board in the prior art.

The middle connecting portion 43 has plural hollow squares 71, as shown in FIG. 7, for saving a molding material. The first and second terminal seats 41, 42 are made of the molding material injected from a plastic injection molding machine and the molding material is a liquid plastic. Furthermore, because the finished product IDC 40 is formed integrally, and the eight terminals 31, 32 and the double-rows terminal seats 41, 42 are seamlessly assembled, there is no interval therebetween and the area of the terminals 31, 32 to expose in the air can be significantly decreased for avoiding an incursion of the water and the salt. Consequently, the situation that the terminals 13 are unstable as described in FIG. 1 will not be happened, the network performance also can be improved during communicating, and the synchronicity and the stability can be improved simultaneously.

Further to another viewpoint, the present invention is an insulation displacement connector structure for connecting a conducting wire 47 and a circuit 48. The IDC structure includes a first and a second terminals 31, 32 and a first and a second terminal seats 41, 42 formed integrally and connected to the first and second terminals 31, 32 seamlessly. The structure can further include a middle connecting portion 43 located between and connecting the first and second terminal seats 41, 42 and formed integrally with the first and second terminal seats 41, 42.

In view of the aforesaid, the present invention is actually a completely new method. The present invention utilizes the glued ability of the liquid plastic during forming the double-rows terminal seats to simultaneously assemble, encapsulate and fix the eight terminals so as to reduce two steps of aiming the terminals at the pre-kept holes and assembling the inner and outer scoops during the manufacturing process. Furthermore, the present invention is formed integrally which therefore can accelerate the production speed of manufacturing the IDC. Consequently, the present invention is extremely suitable for industrial production.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for manufacturing an insulation displacement connector, comprising steps of:

providing an injection molding device;

providing a first and a second terminals, wherein said first terminal seat has a fixing tenon for being fixed in a keystone jack;

putting said first and said second terminals into said injection molding device; and injecting a molding material into said injection molding device for forming a first and a second terminal seats and a middle connecting portion, so that said first and said second terminals are simultaneously encapsulated and assembled by said first and said second terminal seats for completing said insulation displacement connector.

2. A method according to claim 1 wherein said keystone jack has a pedestal scoop for holding said fixing tenon of said first terminal seat.

3. A method for manufacturing an insulation displacement connector, comprising steps of:

providing an injection molding device;

providing a first and a second terminals, wherein said first terminal seat has a fixing tenon for being fixed in a keystone jack;

injecting a molding material into said injection molding device for forming a first and a second terminal seats and a middle connecting portion; and simultaneously putting said first and said second terminals into said injection molding device, so that said first and said second terminals are encapsulated and combined by said first and said second terminal seats for completing said insulation displacement connector.

4. An insulation displacement connector structure for connecting a conducting wire and a circuit, comprising:

a first and a second terminal seats;

a middle connecting portion located between and connecting said first and said second terminal seats, wherein said middle connecting portion has plural hollow squares for saving a molding material; and a first and a second terminals disposed in said first and said second terminal seats respectively.

5. A structure according to claim 4 wherein said first and said second terminal seats are seamlessly assembled to said first and said second terminals.

6. A structure according to claim 4 wherein said first and said second terminal seats are made of said molding material injected from a plastic injection molding machine and said molding material is a liquid plastic.

7. A structure according to claim 4 wherein said first terminal seat has a fixing tenon for being fixed in a keystone jack.

8. A structure according to claim 7 wherein said keystone jack has a pedestal scoop for holding said fixing tenon of said first terminal seat.

9. A structure according to claim 7 wherein said keystone jack has a separated scoop for separating said keystone jack from a SIP (Snap In Plate).

10. A structure according to claim 7 wherein said first terminal seat has a first tenon for fixing a wire clip thereon and said wire clip has a plate bottom for being assembled to said keystone jack.

11. A structure according to claim 10 wherein said second terminal seat has a second tenon for cooperating with said first tenon to fix said wire clip on said first and said second terminal seats.

12. A structure according to claim 11 wherein said first and said second tenons are respectively located at a front end and a back end of said insulation displacement connector for further fixing a first and a second scoops of said wire clip.

13. An insulation displacement connector structure, comprising:

a first and a second terminals;

a first and a second terminal seats formed integrally and connected to said first and said second terminals seamlessly; and a middle connecting portion having plural hollow squares located between and connecting said first and said second terminal seats and formed integrally with said first and said second terminal seats.

14. A structure according to claim 13 wherein said first and said second terminal seats are made of said molding material injected from a plastic injection molding machine and said molding material is a liquid plastic.

15. A structure according to claim 13 wherein said first terminal seat has a fixing tenon for being fixed in a keystone jack.

16. A structure according to claim 15 wherein said keystone jack has a pedestal scoop for holding said fixing tenon of said first terminal seat.

* * * * *